US008118719B1

(12) United States Patent
Stassi

(10) Patent No.: US 8,118,719 B1
(45) Date of Patent: Feb. 21, 2012

(54) EXERCISE METHOD FOR THE ARMS

(76) Inventor: Joseph Michael Stassi, Long Beach, CA (US)

( * ) Notice: Subject to any disclaimer, the term of this patent is extended or adjusted under 35 U.S.C. 154(b) by 0 days.

(21) Appl. No.: 12/590,573

(22) Filed: Nov. 10, 2009

(51) Int. Cl.
*A63B 21/02* (2006.01)

(52) U.S. Cl. ..... 482/124; 482/44; 482/47; 482/48

(58) Field of Classification Search ..... 482/44–49, 482/124, 139; 434/247
See application file for complete search history.

(56) References Cited

U.S. PATENT DOCUMENTS

| | | | | |
|---|---|---|---|---|
| 3,640,532 | A * | 2/1972 | Bauer | 482/44 |
| 4,291,871 | A | 9/1981 | Lippert | |
| 4,323,232 | A | 4/1982 | Terpening | |
| 4,591,151 | A | 5/1986 | Hensley | |
| D301,271 | S | 5/1989 | Greenfeld et al. | |
| 4,840,370 | A | 6/1989 | Biddlecombe | |
| 5,005,824 | A | 4/1991 | Eichel | |
| 5,062,625 | A | 11/1991 | Vonk | |
| 5,072,927 | A | 12/1991 | Santos | |
| 5,383,827 | A * | 1/1995 | Stern | 482/47 |
| 5,569,124 | A | 10/1996 | Raynie et al. | |
| 5,820,522 | A | 10/1998 | Smallwood et al. | |
| 6,146,319 | A * | 11/2000 | Tarail | 482/139 |
| 6,179,751 | B1 * | 1/2001 | Clears | 482/48 |
| D445,856 | S * | 7/2001 | McCraw | D21/684 |
| 6,817,967 | B1 * | 11/2004 | Ott et al. | 482/48 |
| 6,835,169 | B2 * | 12/2004 | Tamaribuchi | 482/139 |
| 6,986,728 | B2 | 1/2006 | Kasun | |
| 7,104,934 | B1 | 9/2006 | Smith | |
| D546,954 | S * | 7/2007 | Takasaka | D24/190 |
| 7,381,156 | B2 | 6/2008 | Silagy | |
| 7,731,633 | B1 * | 6/2010 | Williams | 482/47 |
| 2003/0087729 | A1 * | 5/2003 | Kasun | 482/48 |

* cited by examiner

*Primary Examiner* — Glenn Richman
(74) *Attorney, Agent, or Firm* — Gene Scott; Patent Law & Venture Group

(57) ABSTRACT

An exercise routine includes holding an elastic band in clenched fists and rotating the fists against the elastic restraining force of the elastic band while obtaining leverage through the contact of both hands. In one approach the right arm is rotated in the clockwise direction while in another approach the right arm is rotated in the counter-clockwise direction. The left arm rotates in the opposite sense to that of the right arm. By rotating the fists, wrists, and lower arms against elastic force, the biceps and triceps muscles are worked, and by repeating the exercise over a controlled program of repetitions and sets with increasing resistance, the arm muscles can be strengthened.

2 Claims, 3 Drawing Sheets

EXERCISE METHOD FOR THE ARMS

BACKGROUND OF THE INVENTION

1. Field of the Present Disclosure

This disclosure relates generally to resistance exercising and in particular to the exercising of muscles of the arms including the biceps and triceps muscles.

2. Description of Related Art Including Information Disclosed Under 37 CFR 1.97 and 1.98

Terpening, U.S. Pat. No. 4,323,232, discloses a method of exercising using an elastic band wherein the band is worn around the wrist just below the hand and includes a protrusion mounted on the inside of the band and positioned to apply pressure to the flexor Capri ulnaris muscle near the base of the hand while the hand is involved in an athletic activity. Vonk, U.S. Pat. No. 5,062,625, discloses a hand exerciser having an elastic structure with loops for receiving all five fingers of one hand at the terminal joint. The loops are connected to a common portion by elastic strips with the thumb essentially in a counterpoised position relative to the other fingers. Exercising is conducted by moving the hand between a flat orientation and a cupped orientation. Kasun, U.S. Pat. No. 6,986,728, discloses an elastic device with four loops connected in a side-by-side arrangement where the loops are sized to engaged four fingers of a hand in the manner of a conventional ring on each finger. The elastic loops are relaxed when the fingers are in side-by-side adjacency, and are stretched when the fingers are spread apart as with the palm of the hand on a flat surface.

The related art described above discloses elastic devices including simple bands which are used for the strengthening of the finders, hand, and wrist for general conditioning and for overcoming disease and malfunction. However, the prior art fails to recognize or teach the method of the present invention whereby, the use of an elastic device held in the hands is able to provide benefit in the exercise and strengthening of the arm muscles. The present disclosure distinguishes over the prior art providing heretofore unknown advantages as described in the following summary.

BRIEF SUMMARY OF THE INVENTION

This disclosure teaches certain benefits in construction and use which give rise to the to objectives described below.

It has been discovered that by rotating the hands against a resistive force it is possible to build strength and provide definition and firming in a person's arms. It has also been discovered that by doing such rotations against resistance, with each hand using leverage against the other hand, such exercise can be conducted with a simple elastic band or series of bands of progressive elastic constant. Therefore, it is believed that the present method is an important advance in the field of muscle training and endurance and athletics providing a low cost and highly convenient exercise technique that may be practiced by persons young and old, healthy or infirm and at any location.

In a first portion of the present method the elastic band is held within clenched fists with the fists positioned palm-to-palm. The hands are then mutually rotated about the axes of the lower arms in opposing directions so that the palms of both hands are facing upward and the blades of the hands are in mutual contact achieving leverage against each other in order to stretch the elastic band. The hands are then rotated back to their initial position palm-to-palm. This simple exercise may be repeated a number of times as desired, and as strength improves, an elastic band with greater resistance may be employed as with protocols for progressive resistive exercising. In an extension of the above movement, the hands may be rotated from the initial palms-touching position to a palms down attitude and this movement may be conducted alternately with the palms-up rotation. The combination of palms-up and palms-down rotations provides an exercise routine for the full range of possible rotation of the hands against resistance and therefore workout of the attendant muscle groups. This series of exercises against resistance focuses on the forearms and biceps muscles of the arms.

In a second portion of the present method the elastic band is held within clenched fists with the fists positioned back-to-back. The hands are then mutually rotated about the axis of the lower arm in opposing directions so that the palms of both hands are facing downward and the index fingers and/or the thumbs of the hands are in mutual contact achieving leverage against each other in order to stretch the elastic band. The hands are then rotating back to their initial positions back-to-back. As with the first portion of the present method, described above, this simple exercise may be repeated a number of times as desired, and as strength improves, an elastic band with greater resistance may be employed to increase the strength of the arm muscles. This provides an exercise routine for the full range of possible rotation of the hands and therefore a workout of the attendant muscle groups. This portion of the present method focuses on the forearm and triceps muscles of the arms.

The elastic band used in the above exercises preferably is a continuous loop with a width about equal to the length of the first and second digits of the adult hand, about one inch; and has an unstretched length of about ten inches, so as to extend through the fists of both hands and also between the hands. The band has an elastic constant capable of working the muscles that are involved in the above described routines, and as with all progressive resistance exercise routines, the resistance to stretching of the elastic band will be selected to adequately work the muscles of the exerciser.

A primary objective inherent in the above described apparatus and method of use is to provide advantages not taught by the prior art.

A further objective is to exercise the muscles of the arms and chest by simple rotations of the hands against resistive forces.

Another objective is to provide an exercise band that is easily wrapped around the hands of a person doing the exercises of this invention method and wherein the exercise band provides an operational elastic restraining force of a magnitude sufficient for working arm muscles in a manner recognized by those of skill in the art as providing standard progressive resistance training benefits.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Figure 6:
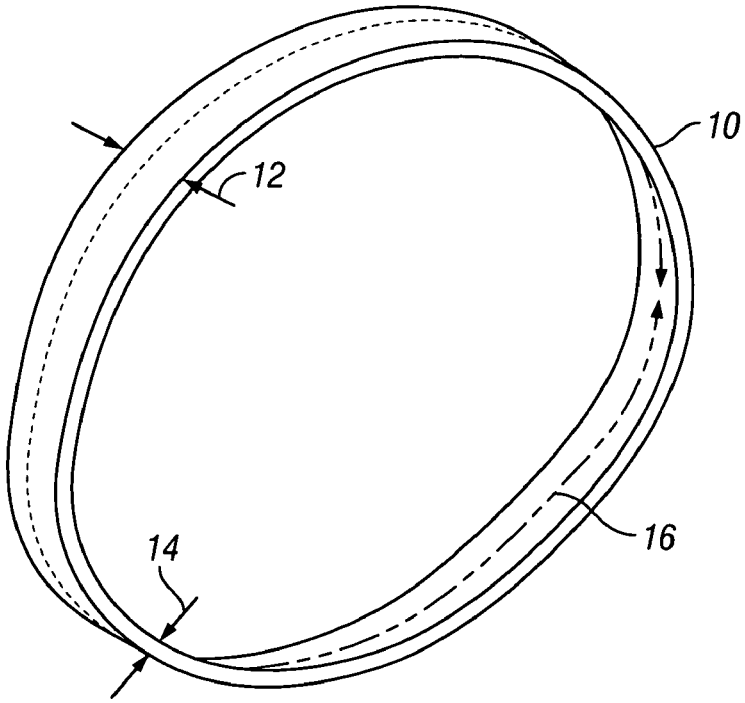
FIG. 6 is a perspective view of a preferred embodiment of the elastic band.

The present invention is an exercise method for application to the human arm muscles and when practiced with the arms close to the body, it exercises the chest muscles as well especially the pectorals. It is presented herein as a means for strengthening, firming and defining the related portions of a person's anatomy. Described now in detail is a method of exercising the muscles of both arms and the chest of a person (a user) using a simple resistance device i.e., an elastic band 10; please see FIG. 6 which shows a typical band useful in this invention and which has a band width 12, a band thickness 14 and a band circumferential length 16. The elastic band 10 may be a continuous loop, or it may be a simple length of elastic material such as a bungee cord. In this description and in the following claims we refer to the resistance device of this invention as an elastic band 10, and by this is meant and understood that this terminology refers herein to any elastic fixture that may be applied to the method as described herein.

Figure 1:
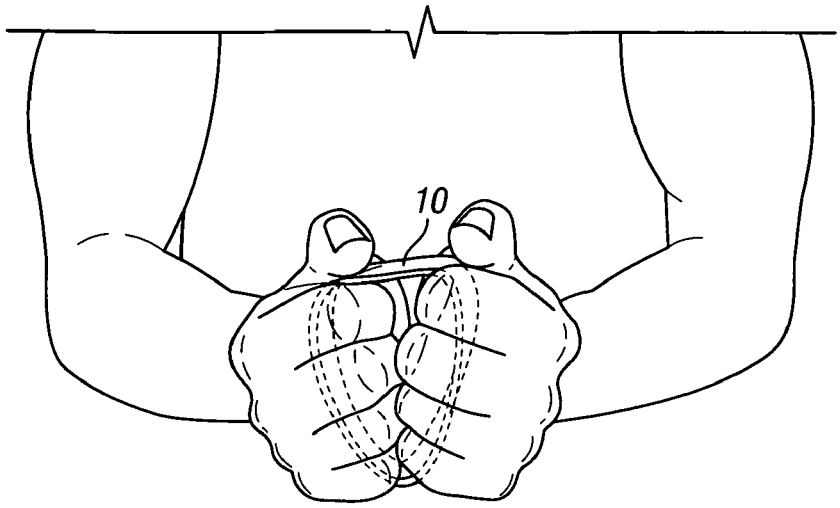
FIG. 1 is a perspective view of the presently described method shown with an unstretched elastic band held in two hands with palms facing and fists clenched.
Figure 2:
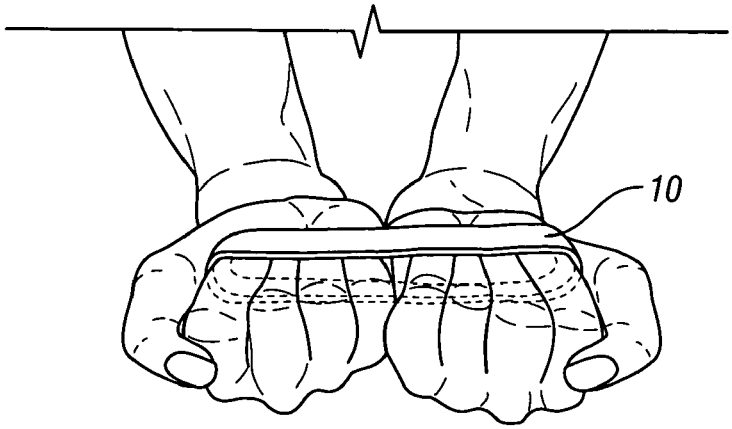
FIG. 2 is a further perspective view of the two hands of FIG. 1 shown with both of the hands rotated from the positions of FIG. 1 to a palms-up attitude thereby stretching the elastic band.
Figure 3:
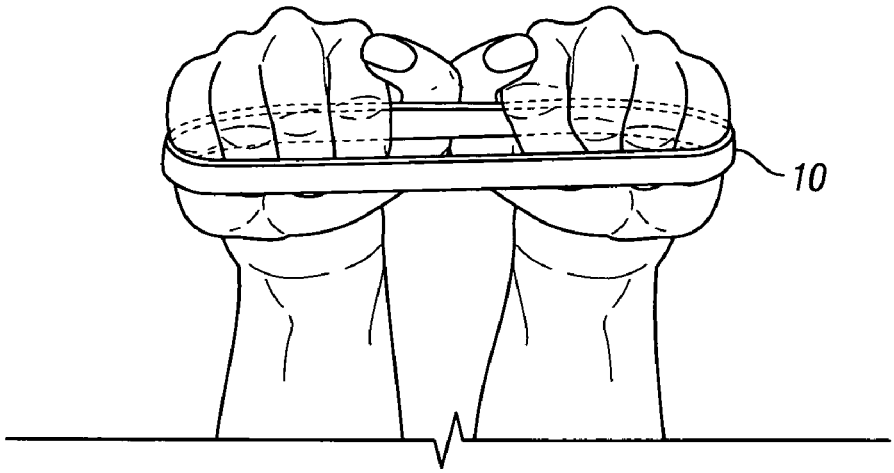
FIG. 3 is a further perspective view of the two hands of FIG. 1 shown with both of the hands rotated from the positions of FIG. 1 to a palms-down attitude thereby stretching the elastic band.

We refer herein in particular to the biceps and to the triceps muscles of the arms. However, the present method involves almost all of the muscles of the hands, lower arms and wrists, and the upper arms and to some degree the chest as well. In a first position, shown in FIG. 1, the elastic band 10 is gripped within clenched fists but is unstretched and palms and fingers of the clenched fists are in mutual contact. Next, as shown in FIG. 2, both of the fists are rotated by 90° simultaneously about the longitudinal axes of the lower arms, into palms-up second positions while keeping the blades, or sides of the clenched fists in contact and thereby stretching the elastic band 10 and exercising the forearms, biceps, etc. Further, from the first position, the clenched fists may be rotated simultaneously into palms-down third positions, as shown in FIG. 3, keeping thumbs, and, depending on how the thumbs are positioned, the index fingers of the clenched fists in contact, and thereby stretching the elastic band 10 and further exercising the forearms and biceps over a full range of rotation of the fists. The preferred exercise, in a first portion of the method of this invention, is therefore to move from position 1 to position 2, and then back to position 1; and then to position 3, and so-on repetitively.

Figure 4:
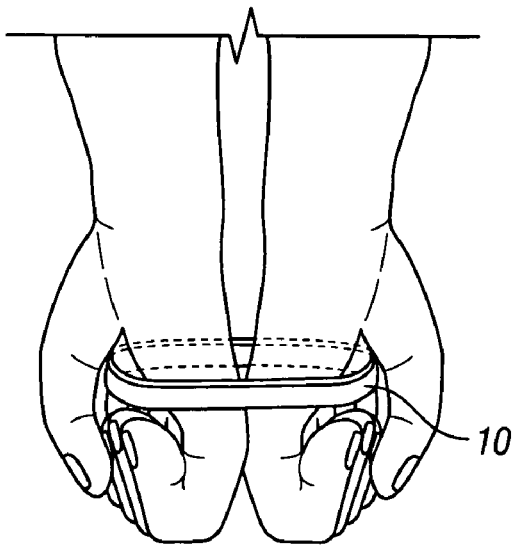
FIG. 4 is a perspective view of the presently described method shown with the unstretched elastic band held in the two hands with backs of the hands facing and in contact and with fists clenched.
Figure 5:
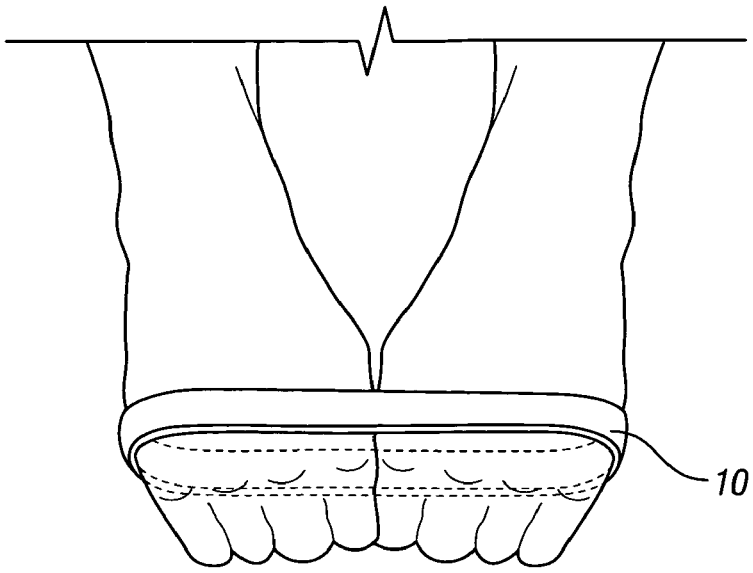
FIG. 5 is a further perspective view of the two hands of FIG. 4 shown with both of the hands rotated from the positions of FIG. 4 to a palms-down attitude thereby stretching the elastic band.

The previous paragraph describes one portion of the present exercise method. In a second portion of the present exercise method, shown in FIGS. 4 and 5, the hands grip the elastic band 10 within clenched fists of the user with the elastic band 10 unstretched and with the backs of the hands in contact. This is the fourth position of the method of the present invention. A fifth position, shown in FIG. 5, is achieved by rotation of the hands over 90° to a palms-down attitude with the index fingers in contact, whereby the elastic band 10 is stretched. Each hand provides leverage against the other in positions two, three and five. This is a unique characteristic of the present method. In the first portion of the exercise method shown in FIGS. 1-3 the arms are bent at the elbow, while in the second portion shown in FIGS. 4 and 5, the arms are held outstretched.

Either the first or the second portion of the present method, as described above may be used without the other portion to the benefit of the exerciser, but the present method produces full benefit when both portions are included in a workout schedule. It has been found that in particular the biceps and related muscle mass benefits preferentially from the first portion of the present method, while the triceps and its related muscle mass benefits preferentially from the second portion of the present method. When used in the combined method of this invention, the benefit to the arms and related anatomical structures is synergistically complete.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

When the present inventive method is used in progressive resistance training, sets of repetitions are included in a workout routine, as for instance, every other day conducting three sets of between eight and twelve repetitions of each of the first and the second portions of the method described above with an elastic band that provides enough resistance to allow a workup from eight to twelve repetitions without overstraining the wrists, forearms, biceps or triceps. When twelve repetitions is achievable, an elastic band with an elastic constant that permits only about eight repetitions is substituted for the weaker band and when twelve repetitions with the stronger band is achieved, a yet stronger band is used, and so on.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A method of using an elastic band comprising: forming the band of an elastic material configured as a continuous loop; the band having a width of approximately one-inch; the band having an unstretched circumference capable of extending through and around the clenched fists of a person when the fists are positioned with palms abutting; the band having an elasticity capable of stretching to allow a 90° rotation of each of the clenched fists, while maintaining first contact; comprising the steps of:

in a first band state, placing the band around the clenched fists of the person wherein the elastic band is unstretched and palms and fingers of the clenched fists are in mutual contact;

rotating the clenched fists simultaneously while keeping sides of the clenched fists in contact and thereby stretching a portion of the elastic band into a second band state; and moving repetitively between the first and the second band states for a selected number of repetitions, wherein the elastic constant of the band is sufficient to provide beneficial working of the muscles and thereby to condition the portion of the band.

2. The method of claim 1 for further conditioning the band comprising the further steps of rotating the clenched fists simultaneously into a thumbs touching position thereby establishing a third band state by stretching a further portion of the elastic band.

* * * * *